United States Patent [19]

Jacobsen et al.

[11] Patent Number: 4,561,782

[45] Date of Patent: Dec. 31, 1985

[54] TAMPING AND STIRRING ROD FOR USE WITH A FOOD AND BEVERAGE BLENDER

[76] Inventors: Douglas C. Jacobsen; Dennis D. Jacobsen, both of 320 Kristmont, Lodi, Calif. 95240

[21] Appl. No.: 648,871

[22] Filed: Sep. 7, 1984

[51] Int. Cl.[4] ..... B01F 15/00

[52] U.S. Cl. ..... 366/349; 366/205; 366/347

[58] Field of Search ..... 366/349, 348, 242, 243, 366/249, 248, 255, 256, 129, 130, 342, 343, 205, 314, 347

[56] References Cited

U.S. PATENT DOCUMENTS

| | | | |
|---|---|---|---|
| 2,851,258 | 9/1958 | Siehrs | 366/248 |
| 3,295,836 | 1/1967 | Langella | 366/248 |
| 3,326,533 | 6/1967 | Sturrup | 366/242 |
| 3,328,005 | 6/1967 | McMaster | 366/343 |
| 3,417,972 | 12/1968 | Vincent | 366/242 |
| 3,576,168 | 4/1971 | Thylstrup | 366/349 |

*Primary Examiner*—Robert W. Jenkins

*Attorney, Agent, or Firm*—W. Edward Johansen

[57] ABSTRACT

The present invention is a tamping and stirring rod for use with a receptacle of a food and beverage blender including a plurality of rotating blades disposed inside. The receptacle has an open top and a top cover formed out of a flexible material with a hole in its center. The tamping and stirring rod urges either foodstuff or ice cubes into the receptacle. The tamping and stirring rod includes an elongated, substantially cylindrical member which has a distal end and a proximal end and which is formed out of a flexible material. The elongated, substantially cylindrical member is an integral member with a foot at its distal end. A plastic cap is snugly inserted into the top cover and has a bore having a diameter that is slightly larger than the diameter of the elongated, substantially cylindrical member which is concentric to the hole in the top cover and through which the elongated, substantially cylindrical member is slidably inserted. A collar having an outer diameter that is larger than the diameter of the bore in the plastic cap is snugly, but slidably coupled to the elongated, substantially cylindrical member at its proximal end so that the elongated, substantially cylindrical member can not pass completely through the bore in the plastic cap and contact any of the rotating blades. The combination of the flexible top cover, the plastic cap and the collar enables the foot at the distal end of the elongated, substantially cylindrical member to contact the sidewalls of the receptacle.

1 Claim, 3 Drawing Figures

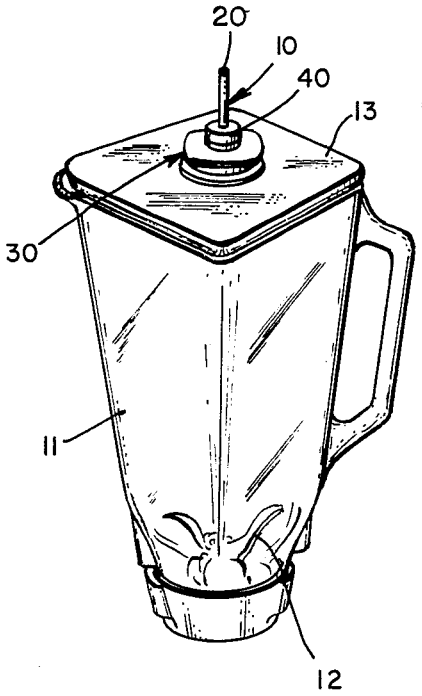
Fig. 1.
Fig. 2.
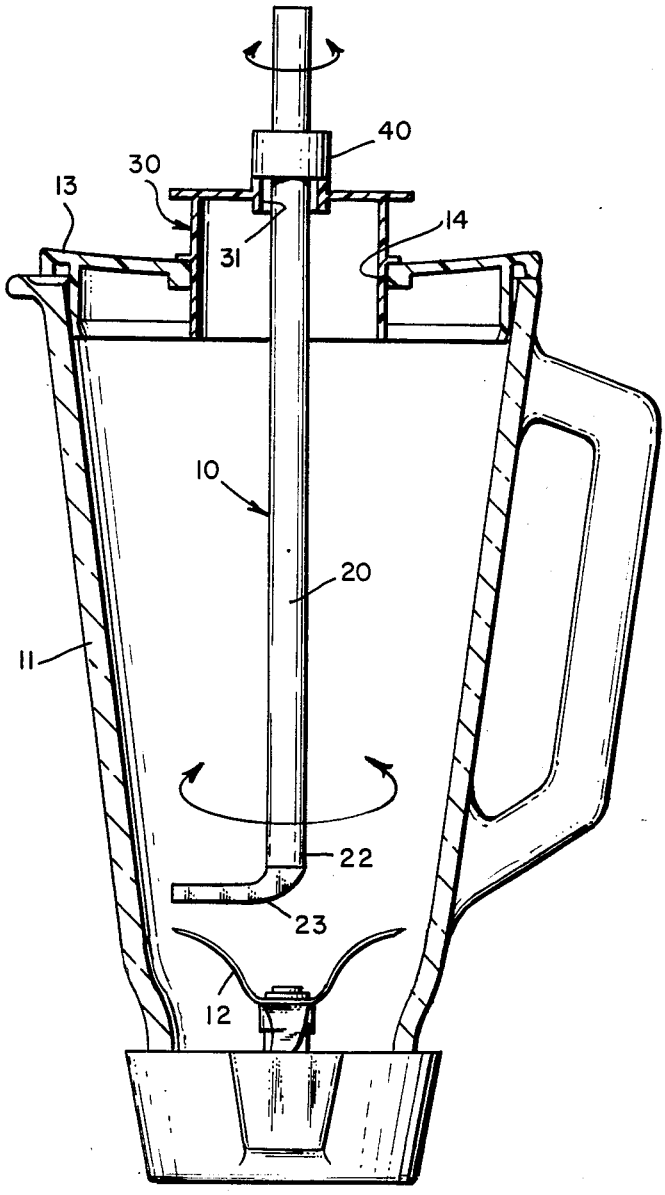
Fig. 3.
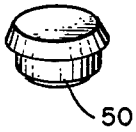

TAMPING AND STIRRING ROD FOR USE WITH A FOOD AND BEVERAGE BLENDER

BACKGROUND OF THE INVENTION

1. Field of the Invention

The present invention relates to devices for urging either foodstuff or ice cubes into a receptacle of a food and beverage blender and more particularly to a tamping and stirring rod for use in conjunction with a receptacle of a food and beverage blender wherein the tamping and stirring rod is loosely coupled to the top cover of the receptacle in such a manner that it can contact the sidewalls of the receptacle without being able to contact the rotating blades thereof.

2. Description of the Prior Art

U.S. Pat. No. 3,895,548, entitled Blender Packing Device, issued to Delsford B. Sauve on July 22, 1975, teaches a blender packing device for urging food matter into a blender which includes a first generally planar elongated blade which has a plurality of transversely extending fins and a second generally planar elongaged blade which has a plurality of transversely extending fins. The first and second generally planar blades are fixedly coupled at right angles to each other. The blades are preferrable formed out of a plastic material such as a Plexiglass or a Lucite. The prior art for this patent includes a plunger device which U.S. Pat. No. 1,412,536 teaches and which has a generally rounded head for urging foodstuff into a meat grinder. The plunger device has not been particularly suitable for use in a blender since its relatively massive nature tends to bend the relatively light blades which are typically used in a blender. The blender packing device facilitates the urging of foodstuff into the blender without damagaging its blades and also enables its operator to have maximum visibility of its blades and the blender packing device which he is using.

U.S. Pat. No. 3,346,029, entitled Safety Spatula for Food Blender, issued to William B. Harris, Jr. on Oct. 10, 1967, teaches a safety spatula for use in conjunction with a food to tamp and stir food which the food blender is processing. In the processing of foods in a food blender it is common practice to employ an ordinary spatula having a rubber-covered end portion for tamping and stirring the food as supplied to the food blender whereby the food is advanced downwardly in the receptacle of the food blender in opposing relation while at the same time scraping the food from the sides of the receptable to promote the comminuting and mixing action of the revolving blades which are formed out of hardened steel and are rotated at high speeds. Care must be used to prevent the spatula from getting too close to the spinning blades or either damage to the blades and spatula or personal injury to the operator of the food blender may occur.

U.S. Pat. No. 2,757,909, entitled Agitator Device for a Mixer, issued to Joseph C. Wayne on Aug. 7, 1956, teaches an agitator device for use in conjunction with a food mixer so that the food mixer can disintegrate relatively hard materials such as ice cubes in the absence of appreciable amounts of liquid. Without the use of the agitator device hard ice cubes or the like merely bounced on top of the rotating blades of the food mixer.

U.S. Pat. No. 3,088,345, entitled Kitchen Utensil, issued to Homer C. Campbell on May 7, 1963, teaches a kitchen utensil for use in combination with an automatic garbage disposer. The kitchen utensil is used to force waste material into the automatic garbage disposer. The kitchen utensil is constructed so as to be incapable of contacting disposer blades or other moving parts therein thereby preventing both injury to users and damage to the disposer blades while effectively forcing the waste material into the automatic garbage disposer.

U.S. Pat. No. 3,765,275, entitled Garbage Grinder Stuffer, issued to Charles W. Johnsen on Oct. 16, 1973, teaches a stuffer for feeding waste material to a garbage grinder which has a central neck and stuffer and handhold elements on the ends thereof. The stuffer is an integral member formed out of a plastic material.

U.S. Pat. No. 2,066,997, entitled Tamping Implement, issued to Ottilie Mueller on Jan. 5, 1937, teaches a tamping implement which includes an elongated member, a tamping head which is mechanically coupled to the elongated member and an operating handle which is mechanically coupled to the elongated member and which conveniently manipulates the tamping head inside a fruit jar or the like.

U.S. Pat. Nos. 1,480,914, 2,758,623, 2,771,111, 3,537,691 and 3,820,692 are patents which teach blenders.

SUMMARY OF THE INVENTION

In view of the foregoing factors and conditions which are characteristic of the prior art it is the primary object of the present invention to provide a tamping and stirring rod for urging either foodstuff or ice cubes into a receptacle of a food and beverage blender wherein the tamping and stirring rod is loosely coupled to the top cover of the receptacle in such a manner that it can contact the sidewalls of the receptacle without being able to contact the rotating blades thereof.

In accordance with the present invention an embodiment of a tamping and stirring rod for use with a receptacle of a food and beverage blender including a plurality of rotating blades disposed inside is described. The receptacle has an open top and a top cover formed out of a flexible material with a hole in its center. The tamping and stirring rod urges either foodstuff or ice cubes into the receptacle. The tamping and stirring rod includes an elongated, substantially cylindrical member which has a distal end and a proximal end and which is formed out of a flexible material. The elongated, substantially cylindrical member is an integral member with a foot at its distal end. A plastic cap is snugly inserted into the top cover and has a bore having a diameter that is slightly larger than the diameter of the elongated, substantially cylindrical member which is concentric to the hole in the top cover and through which the elongated, substantially cylindrical member is slidably inserted. A collar having an outer diameter that is larger than the diameter of the bore in the plastic cap is snugly, but slidably, coupled to the elongated, substantially cylindrical member at its the proximal end so that the elongated, substantially cylindrical member can not pass completely through the bore in the plastic cap and contact any of the rotating blades. The combination of the flexible top cover, the plastic cap and the collar enables the foot at the distal end of the elongated, substantially cylindrical member to contact the sidewalls of the receptacle.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of a receptacle of a food and beverage blender and a tamping and stirring rod which is loosely coupled to the top cover of the receptacle and which has been constructed in accordance with the principles of the present invention.

FIG. 2 is a side elevational view in cross-section of the receptacle of the food and beverage blender and the tamping and stirring rod of FIG. 1.

FIG. 3 is a perspective drawing of a cap for the top cover of the receptacle of the a food and beverage blender of FIG. 1 for use after the operator has removed the tamping and stirring rod from the receptacle.

DESCRIPTION OF THE PREFERRED EMBODIMENT

In order to best understand the present invention it is necessary to refer to the following description of its preferred embodiment in conjunction with the figure of accompanying drawing. Referring to FIG. 1 in conjunction with FIG. 2 a tamping and stirring rod 10 is used with a receptacle 11 of a food and beverage blender. The receptacle 11 includes a plurality of rotating blades 12 disposed inside. The receptacle 11 has an open top and a top cover 13 which is formed out of a flexible material with a hole 14 in its center.

U.S. Pat. No. 3,346,029 teaches a typical food and beverage blender which includes a hollow base and a receptacle, open at the top, which the hollow base supports and which extends upward therefrom. The receptacle has a top cover which an operator may place over its open top. The hollow base encloses an electric motor with a shaft which is arranged vertically and extends above the hollow base. The receptacle has an opening through which the shaft is rotatively coupled to a blade unit which is removably connected to the upper end of the shaft by clamping engagement between a nut threaded on its reduced portion and an outwardly facing shoulder thereon. The blade unit includes a plurality of rotating blades which extend radially outwardly from the shaft.

Referring to FIG. 2 the tamping and stirring rod 10 includes an elongated, substantially cylindrical member 20 which has a distal end 21 and a proximal end 22 and which is formed out of a flexible material. The elongated, substantially cylindrical member 20 is an integral member with a foot at its distal end 23. The tamping and stirring rod 10 urges either foodstuff or ice cubes into the receptacle 11. A plastic cap 30 is snugly inserted into the top cover 13 and has a bore 31 having a diameter that is slightly larger than the diameter of the elongated, substantially cylindrical member 20 which is concentric to the hole 14 in the top cover 13 and through which the elongated, substantially cylindrical member 20 is slidably inserted. A collar 40 is formed out of a flexible material, such as rubber, and has an outer diameter that is larger than the diameter of the bore 31 in the plastic cap 30. The collar 40 is snugly, but slidably, coupled to the elongated, substantially cylindrical member 20 at its proximal end 22 in order that the length of the portion of the elongated, substantially cylindrical member 20 inside the receptacle 11 may be adjusted so that the elongated, substantially cylindrical member 20 can not pass completely through the bore 31 in the plastic cap 30 and contact any of the rotating blades 12 therein. The combination of the flexible top cover 13, the plastic cap 30 and the collar 40 enables the foot 23 at the distal end 21 of the elongated, substantially cylindrical member 20 to contact the sidewalls of the receptacle 11.

Referring to FIG. 3 a cap 50 is to be used to cover the bore 41 in the plastic cap 40 when the tamping and stirring rod 10 is not in use. The operator may secure the cap 50 to the proximal end 22 of the elongated, substantially cylindrical member 20 when he is not using it to cover the bore 41 in the plastic cap 40.

From the foregoing it can be seen that a tamping and stirring rod for use with a receptacle of a food and beverage blender has been described. It should be noted that the sketch is not drawn to scale and that distances of and between the figures are not to be considered significant.

Accordingly it is intended that the foregoing disclosure and showing made in the drawing shall be considered only as an illustration of the principles of the present invention.

What is claimed is:

1. For use with a receptacle of a food and beverage blender including a plurality of rotating blades disposed inside the receptacle having an open top and a top cover, which is formed out of a flexible material with a hole in its center, a tamping and stirring rod for urging either foodstuff or ice cubes into the receptacle, said tamping and stirring rod comprising:

a. an elongated, substantially cylindrical member which has a distal end and a proximal end and which is formed out of a flexible material with said elongated, substantially cylindrical member being an integral member with a foot at its said distal end;

b. a plastic cap which is snugly inserted into the top cover and which has a bore which has a diameter which is slightly larger than the diameter of said elongated, substantially cylindrical member and which is concentric to the hole in the top cover and through which said elongated, substantially cyclindrical member is slidably inserted; and c. a collar which has an outer diameter which is larger than the diameter of said bore in said plastic cap and which is snugly, but slidably, coupled to said elongated, substantially cylindrical member at its said proximal end that so that said elongated, substantially cylindrical member can not pass completely through said bore in said plastic cap and contact any of the rotating blades and yet it still can contact the sidewalls of the receptacle.

* * * * *